US006825868B2

(12) United States Patent
Frith

(10) Patent No.: US 6,825,868 B2
(45) Date of Patent: Nov. 30, 2004

(54) RADIATION IMAGE DATA RECORDING METHOD EMPLOYING A ROTATING REFLECTOR AND MULTIPLE RADIATION BEAMS

(75) Inventor: David Ronald Frith, Beds (GB)

(73) Assignee: Fujifilm Electronic Imaging Limited, Herts (GB)

( * ) Notice: Subject to any disclaimer, the term of this patent is extended or adjusted under 35 U.S.C. 154(b) by 19 days.

(21) Appl. No.: 10/319,361

(22) Filed: Dec. 12, 2002

(65) Prior Publication Data

US 2004/0114027 A1 Jun. 17, 2004

(51) Int. Cl.[7] ..... B41J 2/27; B41J 15/14
(52) U.S. Cl. ..... 347/243; 347/260
(58) Field of Search ..... 347/225, 231, 347/233, 243, 259, 260, 239, 241, 255, 256; 359/285, 495

(56) References Cited

U.S. PATENT DOCUMENTS 5,502,709 A 3/1996 Shinada ..... 369/119
5,504,619 A * 4/1996 Okazaki ..... 359/495
5,907,428 A * 5/1999 Yamashita et al. ..... 359/285

* cited by examiner

*Primary Examiner*—Hai Pham
(74) *Attorney, Agent, or Firm*—Sughrue Mion, PLLC

(57) ABSTRACT

A method of recording image data on a record medium, in which at least two radiation beams impinge on a rotating reflector such that the beams are reflected onto a record medium and scanned across the record medium and the reflector rotates. Relative movement is caused between the reflector and the record medium in the directional parallel with the rotational axis of the reflector. The beams are modulated with image information so that the radiation beams expose pixels on the record medium spaced apart along respective scan lines. The angle at which the beams impinge on the reflector is adjusted so that the scan lines coincide to define a common scan line and the pixels exposed by each beam are interleaved along the common scan line.

3 Claims, 3 Drawing Sheets

Fig.3.

| Clock No. | Beam #1 | Beam #3 |
|---|---|---|
| 0 | $X_{10}$ | $X_{30}$ |
| | $Y_{10}$ | $Y_{30}$ |
| 1 | $X_{11}$ | $X_{31}$ |
| | $Y_{11}$ | $Y_{31}$ |
| 2 | $X_{12}$ | $X_{32}$ |
| | $Y_{12}$ | $Y_{32}$ |
| 3 | $X_{13}$ | $X_{33}$ |
| | $Y_{13}$ | $Y_{33}$ |
| 4 | | |
| ⋮ | ⋮ | ⋮ |

RADIATION IMAGE DATA RECORDING METHOD EMPLOYING A ROTATING REFLECTOR AND MULTIPLE RADIATION BEAMS

FIELD OF THE INVENTION

The invention relates to a method of recording image data on a record medium.

DESCRIPTION OF THE PRIOR ART

Imagesetters are well known for recording image data on photographic film or plates, each pixel on the plate being exposed to a radiation beam such as a laser beam having an intensity modulated in accordance with the colour component content of the pixel.

A variety of devices are known including flat bed and cylinder based apparatus.

In these apparatus, a radiation beam which has been modulated in accordance with the image data, is transmitted towards a rotating reflector which reflects the modulated beam onto the record medium. In order to increase the speed of imaging, it is well known to utilize more than one radiation beam so that two or more scan lines can be exposed simultaneously. See for example U.S. Pat. No. 5,502,709.

There is a need to be able to increase the resolution i.e. number of pixels per unit dimension, which can be exposed on the record medium. An obvious solution to this is to slow down the rotation speed of the reflector which will allow increased spatial resolution to be achieved on the record medium. However, conventional reflectors or spinners rotate at very high speed, for example of the order of 40,000 rpm and are mounted on air bearings which are designed to handle this speed. Consequently, it is difficult to adjust the rotational speed of the spinner since this would also require adjustment of the bearing structure.

SUMMARY OF THE INVENTION

In accordance with the present invention, a method of recording image data on a record medium comprises causing at least two radiation beams to impinge on a rotating reflector such that the beams are reflected onto a record medium and scanned across the record medium as the reflector rotates; modulating the radiation beams with image information; and causing relative movement between the reflector and the record medium in a direction parallel with the rotational axis of the reflector so that the radiation beams expose pixels on the record medium spaced apart along respective scan lines, the method further comprising adjusting the angle at which at least one of the beams is incident on the reflector as the reflector rotates such that data defining the image content of successive pixels to be exposed is used to modulate each beam in turn.

We have realised that it is possible to utilize a multi-beam scanner such as a multi-beam imagesetter and instead of arranging the beams simultaneously to expose lines of parallel pixels, we use two (or more) beams to expose successive pixels in turn and thus achieve much higher resolutions without having to vary rotation speeds. By "successive pixels" we mean successive in the fast scan or rotational direction. Indeed, one of the significant advantages of this invention is that conventional apparatus used for multi-beam purposes can be very simply adjusted to effect the invention.

In some cases the scan lines could be partly or completely offset laterally i.e. along the axis of rotation. Preferably, however the angle at which at least one of the beams is incident on the reflector as the reflector rotates is chosen so that the scan lines coincide on the record medium to define a common scan line and the pixels exposed by each beam are interleaved along the common scan line.

Although the invention can be implemented with just two radiation beams, in the preferred example three radiation beams are used. This enables the resolution to be tripled without changing the rotational speed of the reflector.

Typically, the rate of relative movement between the reflector and the record medium in a direction parallel with the rotational axis will be slowed down from the conventional rate in order to equalise the pixel spacing in both directions.

BRIEF DESCRIPTION OF THE DRAWINGS

An example of apparatus for carrying out a method according to the invention will now be described with reference to the accompanying drawings, in which.

DETAILED DESCRIPTION OF EMBODIMENT

The method can be implemented on apparatus similar to that described in U.S. Pat. No. 5,502,709 incorporated herein by reference. A slightly modified form of that apparatus will now be described in more detail.

Figure 1:
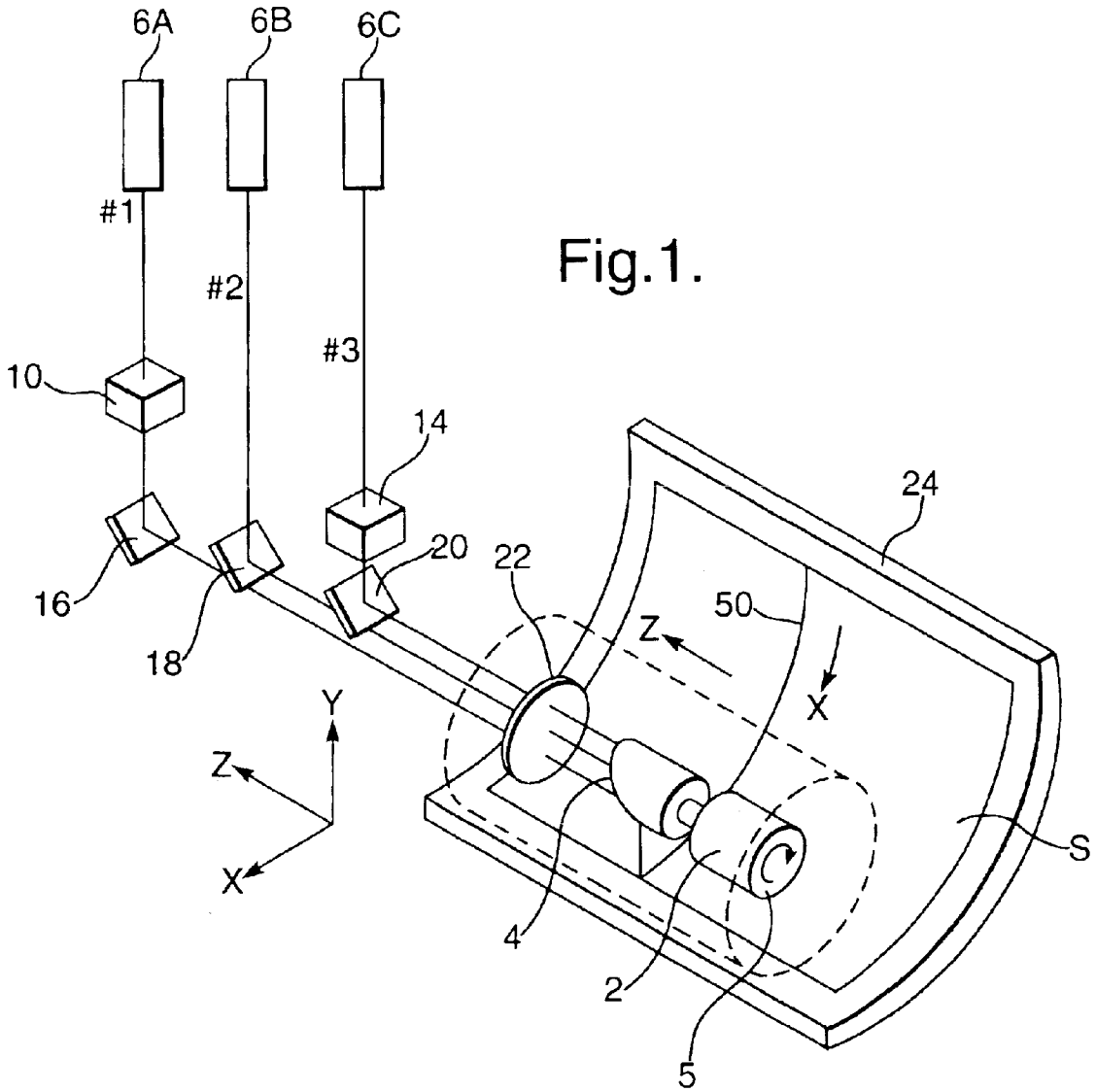
FIG. 1 is a partial, perspective view of the apparatus.
Figure 2:
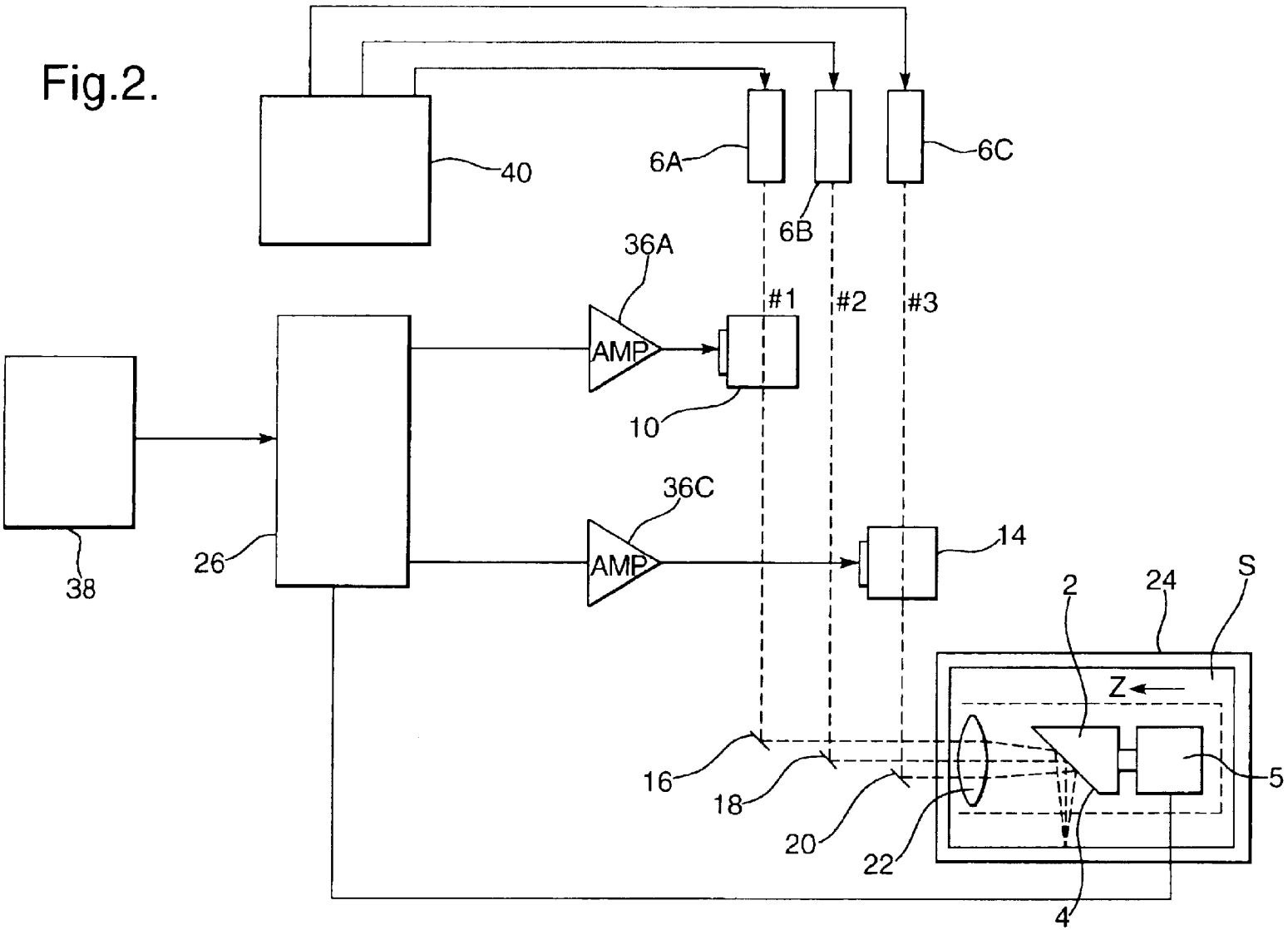
FIG. 2 is a block diagram of the control system for use with the apparatus in FIG. 1; and, FIG. 3 illustrates part of a control table for the control circuit in FIG. 2.

The apparatus shown in FIGS. 1 and 2 comprises three laser beam generators 6A–6C for generating three laser beams #1, #2 and #3 respectively each modulated with image information defining the colour content of pixels of an image, using data stored in a store 40. An acousto-optical device 10 deflects the laser beam #1 in the direction of one or both of the X and Y axes, and an acousto-optical device 14 deflects the laser beam #3 in the direction of the X and Y axes. These modulators could instead be electro-optical modulators. Mirrors 16, 18 and 20 reflect the laser beams #1, #2 and #3, respectively, towards a condenser lens 22 for condensing the laser beams #1, #2 and #3 onto an optical scanning device 2. The device 2 has a rotating mirror surface 4 for reflecting and leading the laser beams #1, #2 and #3 to a recording sheet S, and a motor 5 for rotating the mirror 4. The recording sheet S is held on an interior surface of a cylindrical drum 24, and the optical scanning device 2 is disposed on the central axis of the drum 24.

FIG. 2 shows a circuit for controlling the acousto-optical devices 10 and 14.

The circuit shown in FIG. 2 comprises a controller 26 responsive to signals from an encoder (not shown) provided in the optical scanning device 2. The controller 26 generates respective, modulated, beam deflection signals which are fed via amplifiers 36*a*, 36*c* to the acousto-optical devices 10 and 14. The signals are modulated in accordance with data in a memory 38.

The controller 26 is responsive to data stored in a memory 38 (to be described below) defining deflection angles for the beams. Of course, in this case the deflection signal for the beam #2 will normally be zero.

The memory 38 is shown in more detail in FIG. 3 and comprises a Table commonly referred to as a circulating table, which comprises for each clock number in a single rotation of the spinner 2 i.e. each encoder pulse, a set of X and Y deflection amounts for the beams #1, #3 to be deflected. Typically, the rotation of the spinner 2 will be broken down to about 1000 clock pulses. Thus, at clock number 1, the beam #1 will be deflected so that its coordinates are determined by deflection amounts $X_{11}$, $Y_{11}$ while beam #3 is deflected by amounts determined by coordinates $X_{31}$, $Y_{31}$.

At any one time, all three beams #1–#3 will be reflected by the mirror 4 on to the record medium S so as to place three dots simultaneously. In this example, the three dots are spaced apart along a common scan line 50. In other examples, the dots (pixels) could be laterally offset although still interleaved in the fast scan direction (i.e. the rotation direction). In all cases, the memory 38 will define a 2D array of pixel data values, the dimensions of the array corresponding to the fast and slow (axial) scan directions respectively. The pixels will be addressed in turn (in sets of three) in the fast scan dimension and used to modulate respective laser beams #1, #2, #3.

In contrast to conventional image setters where each pixel is spaced apart along the scan line 50 by a distance "X", with this embodiment the distance between successive pixels will be "X/3" using the same rotation speed for the mirror 4. Thus, the resolution has been tripled.

Although not shown, the scanning device 2 is also moved laterally along its axis relative to the record medium S i.e. in the Z direction by being mounted on a lead screw which is rotated. Typically, the lead screw will be rotated at a reduced speed compared with the conventional three beam image setter so that successive scan lines 50 are also located a distance X/3 apart. Of course, the lead screw will also be rotated more slowly than the rotational speed of the mirror 4.

I claim:

1. A method of recording image data on a record medium, the method comprising causing at least two radiation beams to impinge on a rotating reflector such that the beams are reflected onto a record medium and scanned across the record medium as the reflector rotates; modulating the radiation beams with image information; causing relative movement between the reflector and the record medium in a direction parallel with the rotational axis of the reflector so that the radiation beams expose pixels on the record medium spaced apart along respective scan lines, the method further comprising adjusting the angle at which at least one of the beams is incident on the reflector as the reflector rotates such that data defining the image content of successive pixels to be exposed is used to modulate each beam in turn, wherein the angle at which at least one of the beams is incident on the reflector as the reflector rotates is chosen so that the scan lines coincide on the record medium to define a common scan line and the pixels exposed by each beam are interleaved along the common scan line.

2. A method according to claim 1, wherein one of said beams impinges on the rotating reflector substantially on its axis of rotation.

3. A method according to claim 1, wherein three radiation beams impinge on the rotating reflector.

* * * * *